United States Patent [19]

Kawai et al.

[11] 4,411,030

[45] Oct. 25, 1983

[54] APPARATUS FOR DRYING GENITALS AND THE POSTERIOR PARTS OF HUMAN BODY

[75] Inventors: Shinji Kawai, Toyota; Koichi Suzuki, Chiryu; Yuji Yamaguchi, Anjo, all of Japan

[73] Assignee: Aisin Seiki Kabushiki Kaisha, Aichi, Japan

[21] Appl. No.: 311,476

[22] Filed: Oct. 14, 1981

[30] Foreign Application Priority Data

Oct. 16, 1980 [JP] Japan ..... 55-147713[U]
Oct. 25, 1980 [JP] Japan ..... 55-152806[U]

[51] Int. Cl.[3] ..... A61H 35/00; A47K 3/22

[52] U.S. Cl. ..... 4/443; 4/420.2; 4/420.4

[58] Field of Search ..... 4/443, 447, 420.1, 420.2, 4/665, 661, 420.4, 420.5, 444

[56] References Cited

U.S. PATENT DOCUMENTS

| | | | |
|---|---|---|---|
| 2,344,561 | 3/1944 | Popil | 4/420.2 |
| 2,875,450 | 3/1959 | Umann | 4/447 |
| 3,247,524 | 4/1966 | Umann | 4/420.2 |
| 3,579,646 | 5/1971 | Lekberg | 4/318 |
| 3,662,407 | 5/1972 | Colucci | 4/420.2 |
| 3,708,806 | 1/1973 | Kemper | 4/318 |
| 3,995,326 | 12/1976 | Umann | 4/420.1 |
| 4,028,745 | 6/1977 | Caniglia | 4/420.2 |
| 4,192,023 | 3/1980 | McComb | 4/448 |
| 4,206,520 | 6/1980 | Fulford | 4/420.2 X |
| 4,237,560 | 12/1980 | Riegelman et al. | 4/447 |
| 4,340,980 | 7/1982 | Fushimi et al. | 4/443 |

*Primary Examiner*—Henry K. Artis
*Attorney, Agent, or Firm*—Sughrue, Mion, Zinn, Macpeak & Seas

[57] ABSTRACT

An apparatus for drying genitals and the posterior parts of a human body after bathing by a bidet device comprises a fan to blow air for drying genitals and the posterior parts provided with electric motor means for rotating a fan, heater means for heating the air, and control circuit means for controlling the temperature of the blown air, said heater means comprising at least two heater elements, alternatively to one or two or more of which the electric power may be supplied, and said control circuit means comprising a thermostat to cut off the electric power supply to one of the heater elements in the heater means when the temperature of the blown air exceeds a predetermined value.

10 Claims, 6 Drawing Figures

APPARATUS FOR DRYING GENITALS AND THE POSTERIOR PARTS OF HUMAN BODY

BACKGROUND OF THE INVENTION

The present invention relates to an apparatus for drying genitals and the posterior parts, i.e., anus or neighbouring portions of a human body, in particular, to an apparatus for drying genitals and the posterior parts which which have been bathed or washed by a bidet device.

An appartaus for drying bathed genitals and the posterior parts has recently become popular together with a bidet device since it is not only effective to preserve health and to cure diseases, and also it gives comfortableness in and after use of a bidet. Conventional drying apparatus, however, possesses drawbacks that it takes a long period of time to complete the drying due to low temperature of drying air and the air temperature can not be adjusted to fit the atmospheric temperature and user's feeling.

SUMMARY OF THE INVENTION

Accordingly it is an object of the present invention to provide an apparatus for drying genitals and the posterior parts which enables to complete the drying in a short time.

It is another object of the present invention to provide an apparatus for drying genitals and the posterior parts on which the drying air temperature may be selected to fit the atmospheric temperature and user's feeling.

It is a further object of the present invention to provide a drying apparatus which is provided with a protection device having a good response to air temperature to prevent overheat of the drying air.

It is a still further object off the present invention to provide a fitting mechanism for the protection device, which is readily mountable.

This and other objects and advantages will become apparent from the following description, taken together with the accompanying drawings.

The present invention provides an apparatus for drying bathed genitals and the posterior parts of a human body comprising:

a fan to blow air for drying genitals and the posterior parts provided with electric motor means for rotating a fan, heater means for heating the air, and control circuit means for controlling the temperature of the blown air, said heater means comprising at least two heater elements, alternatively to one or two or more of which the electric power may be supplied, and said control circuit means comprising a thermostat to cut off the electric power supply to one of the heater elements in the heater means when the temperature of the blown air exceeds a predetermined value.

Preferred embodiments will be illustrated in the accompanying drawings which serves for better illustration of the present invention and not for limitation thereof, in which.

DETAILED DESCRIPTION OF THE INVENTION

Figure 1:
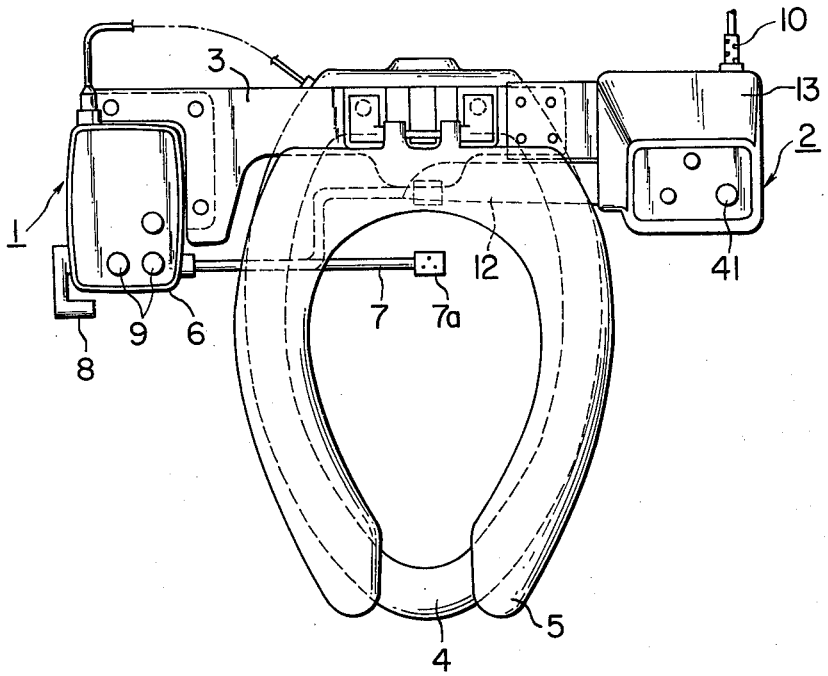
FIG. 1 is a plan view showing a toilet bowl provided with a drying apparatus of the present invention.

Referring to FIG. 1, a bidet device 1 and a device 2 of the present invention for drying the genitals and the posterior parts which have been bathed by means of the bidet device 1 are provided at the opposite ends of an arm 3. The arm 3 is secured between the toilet bowl 4 and a toilet seat pivotted to the top flange thereof. The bidet device 1 provides hot water spray action toward the genitals and the posterior parts and comprises a casing 6 enclosing a pump (not shown), an electric motor (not shown) for driving the pump, a heater for heating water, and a conduit 7 extending from the casing 6 towards the center of the toilet bowl 4, and having a nozzle head 7*a* at the tip end thereof. The bidet conduit 7 is in a non-obstructing position shown in dotted line view in FIG. 1 when the bidet device is not in use. The bidet conduit 7 is swung to the full line view position of FIG. 1 by manipulation of the lever 8 when it is in use.

The drying device 2 comprises a casing 13 and a duct 12 extending from the casing 13 towards the rear portion of the toilet seat 5 for introducing the hot air towards the genitals and the posterior parts which have been bathed. A power switch 41 for energizing the drying device 2 and a temperature select switch 43 are provided on the top of the casing 2. The casing 13 encloses a heater 15, a fan casing 16 and a fan driving motor 24 as shown in FIGS. 2 and 3 in detail.

Figure 2:
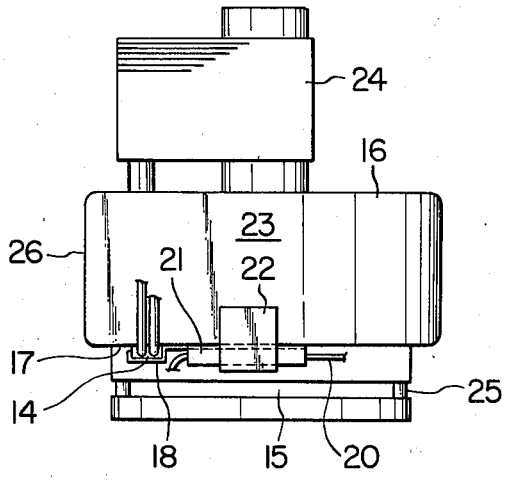
FIG. 2 is a plan view showing the drying apparatus in which a casing is omitted.
Figure 3:
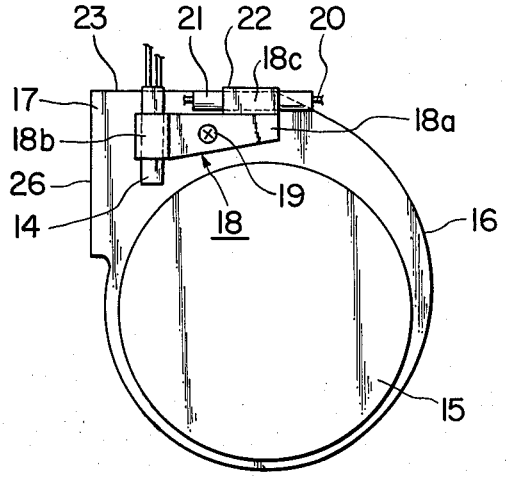
FIG. 3 is a side elevational view showing the drying apparatus of FIG. 2.

Referring to FIGS. 2 and 3, a thermostat 14 for controlling the temperature of the heater 15 and a thermal fuse 21 are closely secured to the side of an outlet port 17 of the fan casing 16 by means of a fitting member 18. The fitting member 18 is made of a material having an excellent thermal conductivity, i.e., metallic material such as aluminium or the like so that the thermostat and the fuse may quickly respond to the changes in the air temperature to enhance the safety of the dryer. The fitting member 18 comprises a plate like middle portion 18*a* secured to the side 17 of the fan casing 16 by means of a single screw 19, a thermostat holder portion 18*b* at one end of the middle portion 18*a*, a thermal fuse holder 18*c* provided in the vicinity of the other end of the middle portion 18*a*; and a rotation stopper portion 22 flushed with the upper surface of the fan casing 16 by bending the stopper portion 22. The thermostat holder 18*b* has an outwardly curved portion so that a space in which the thermostat is adapted is formed with the side 17 of the fan casing 16 as shown in FIG. 2. The thermal fuse holder 18*c* has also an outwardly curved or swelled portion to allow a space in which the thermal fuse 21 is adapted. The thermal fuse holder 18*c* and the stopper portion 22 are provided at one side of the middle portion 18*a*, which is left (as shown in FIG. 3) of the screw 19. Although the screw 19 is clockwise rotated for securing the fitting member 18 to the side 17 of the fan casing 16, the entire fitting member 18 is prevented from being rotated in a direction of the screw rotation since the stopper 22 locating at the right of the screw 19 (as shown in FIG. 3) on the upper end of the middle portion 18*a* seats upon the peripheral upper surface 23 of the fan casing. In the embodiment as illustrated, the rotation stopper portion 22 assumes a plate like form corresponding to the plain upper surface 23 of the casing 23. Alternatively the stopper portion 22 may be curved if the upper surface 23 of the casing 16 is curved.

In FIGS. 2 and 3, the air introduced into the intake 25 is heated by the heater 15. The heated air is then blown from the nozzle of the duct 12 through an outlet 26 by a fan (not shown) in the fan casing 16.

Figure 4:
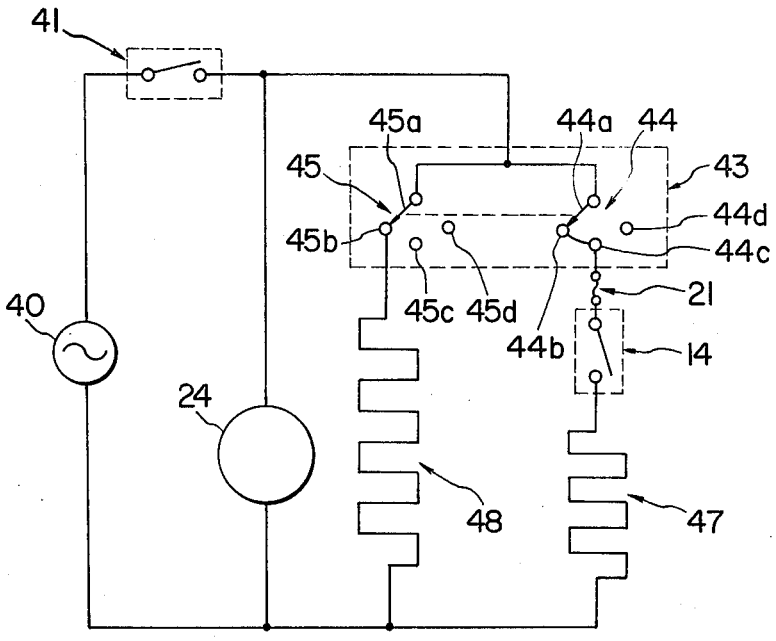
FIG. 4 is a wiring diagram of a circuit for the drying apparatus.
Figure 6:
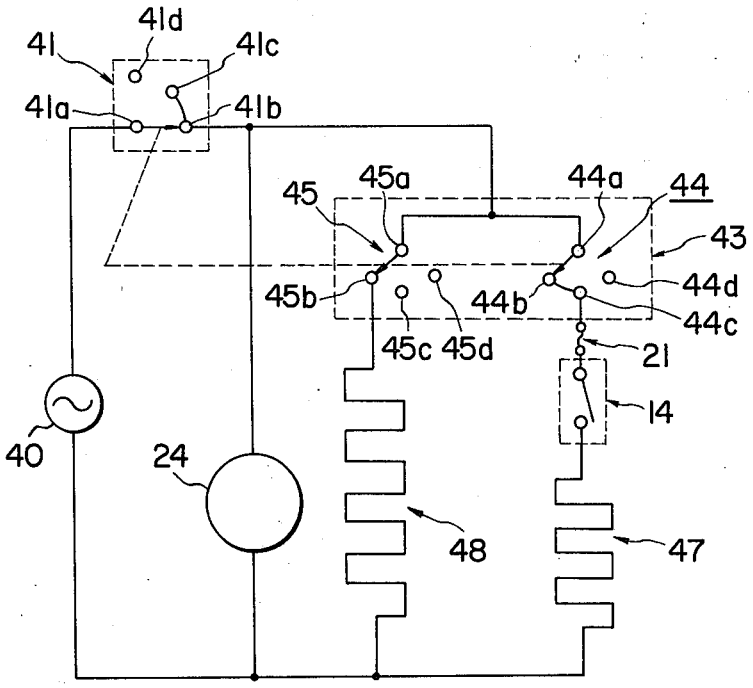
FIG. 6 is a wiring diagram showing a modified circuit of the drying apparatus of FIG. 4.

In the preferred embodiments as shown in FIGS. 4 and 6 two heater elements and corresponding switch means are provided. However, three or more heater elements may be applied accompanied by corresponding switching or shunting means, if appropriate.

Referring to FIG. 4, a power supply 40, for example, a commercial power line is connected with one of the terminals of a power switch 41 through a power cord 10 (as shown in FIG. 1). A fan driving electric motor 24 is connected across the other terminal of the power switch 41 and the power supply 40.

The temperature select switch 43 which selects the temperature of the air heated by heater elements 47 and 48 comprises first and second switches 44 and 45 which are operatively connected each other. The first switch 44 is connected across one terminal of the first heater element 47 and said other terminal of the power switch 41 via the fuse 21 and thermostat 14.

The second switch 45 is connected across one terminal of the second heater element 48 and said other terminal of the power switch 41. The heat release value of the first heater element 47 is higher than that of the second heater element 48.

The first switch 44 comprises a rotary contact 44*a*, first, second and third terminals 44*b*–44*d*. The rotary contact is adapted to be in contact with one of the terminals 44*b*–44*d*. The first terminal 44*b* is connected with the second terminal 44*c*. The second terminal 44*c* is connected with the fuse 21. The third terminal 44*d* is not connected with any terminal.

The second switch 45 comprises a rotary contact 45*a* operatively connected with the rotary contact 44*a* of the first switch 44, a first terminal 45*b* connected with one terminal of the second heater element 48, and second and third terminals 45*c* and 45*d* which are not connected with any other terminal.

When the power switch 41 is closed and the rotary contact 44*a* of the first switch 44 and rotary contact 45*a* of the second switch 45 are connected with the first terminals 44*b* and 45*b* respectively, the first and second heater elements 47 and 48 are energized so that the heated hot air is blown towards the bathed part of the human body. Since the continuous blow of the initial hot air causes a user to feel too hot, the thermostat 14 will open when the air temperature reaches at a predetermined temperature. The thermostat 14 will close when the air temperature becomes slightly lower than the predetermined temperature. The set temperature of the thermostat 14 may be variable or fixed suitable for human body. Thus the temperature of the hot air gets relatively high at an initial stage then become constant at a slightly lower temperature after the thermostat has begun to actuate as depicted by a curve A in FIG. 2. The initial higher temperature peak of the hot air is caused due to delay in heat transfer to the thermostat.

Figure 5:
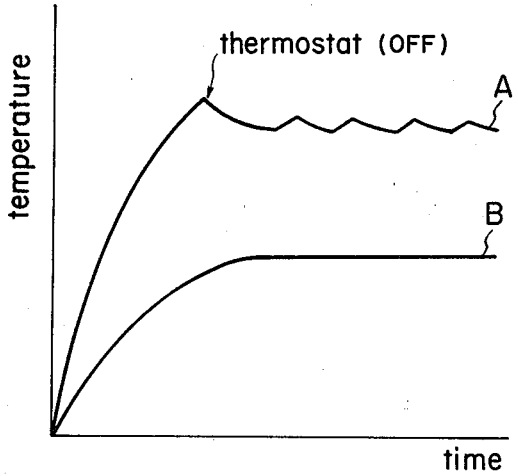
FIG. 5 is a graph showing the relation between the temperature of the hot air and the heater energization time.

When the rotary contact 44*a* of the first switch 44 and the rotary contact 45*a* of the first switch 45 are connected with the second terminals 44*c* and 45*c* respectively, only the second heater element 47 is energized. Then the temperature of the hot air blown by the fan traces a curve B in FIG. 5.

Both the first and second heater elements 47 and 48 are not energized when the rotary contact 44*a* of the first switch 44 and the rotary contact 45*a* of the second switch 45 are connected with the third terminals 44*d* and 45*d* (i.e., position OFF).

In the embodiment shown in FIG. 4, the power switch 41 is independently operable from the first and second switch 44 and 45. Alternatively the power switch 41 may be a rotary switch which is operatively connected with the temperature select switch 43 as in FIG. 6. The rotary power switch 41 is turned on when the rotary contact 41*a* is connected with the first and second terminals 41*b* and 41*c*, and is turned off when the contact 41*a* is connected with the third contact 41*d*. In this case three operation modes may be selected by the manipulation of a single switch.

In the embodiments shown in FIGS. 4 and 6 the fuse 21 is connected between the first switch 44 and the first heater element 47. Alternatively the fuse 21 may be connected between the power switch 41 and the connection between the fan driving motor 24 and the first and second switches 44 and 45 or be connected between the connection between the power switch 41 and the fan driving motor 24, and the connection between the first and the second switches 44 and 45. When the fuse 21 is operated due to overheat of the heater element the motor 24 will stop and both heater elements 47 and 48 will not heat in the former case, but the motor 24 will not stop in the later case.

Accordingly, the blowing temperature of the hot air may be stepwise selected to high and low temperature ranges, wherein at the high temperature range the hot air of the initial higher temperature followed by a relatively lower temperature can be blown so that the overheat of the blown part can be avoided. Besides quick temperature rise of the hot air to allow quickly drying, the safety of the apparatus for drying the genitals and the posterior parts according to the present invention has been enhanced due to the quick response of the thermostat as the fitting member of the fuse and the thermostat is made of a material having good thermal conductivity to allow oprimum temperature control.

Many changes and modifications in the above embodiment of the invention can be made without departing from the scope of the invention. Accordingly, that scope is intended to be limited only by the scope of the appended claims.

What is claimed is:

1. An apparatus for drying genitals and the posterior parts of a human body after bathing by a bidet device comprising:

a fan to blow air for drying genitals and the posterior parts provided with electric motor means for rotating the fan, heater means for heating the air, said heater means comprising at least two heater elements, and control circuit means comprising a thermostat connected in series with one of said heater elements to cut off the electric power supply to said one of the heater elements in the heater means when the temperature of the blown air exceeds a predetermined value while still energizing the other of said heater elements.

2. The apparatus as defined in claim 1, wherein said control circuit means comprises:

a first circuit including first switch means for switching the electric power supply to the first heater element and said thermostat in series connected to the first heater element, and a second circuit including second switch means for switching the electric power supply to the second heater element, said first and second switch means being interlocked with each other so that the first and second heater elements are energized at a first position of said switch means and only the first heater element is energized at a second position of said switch means.

3. The apparatus as defined in claim 1, wherein fuse means is connected in series with the heater means.

4. The apparatus as defined in claim 1 or 2, wherein fuse means is connected in series at least with the first heater element.

5. The apparatus as defined in claim 1 or 2, wherein said fan has a casing with an outlet port and said thermostat is secured on the surface of said fan casing adjacent said outlet.

6. The apparatus as defined in claim 5, wherein said thermostat is secured by means of fitting means having a good thermal conductivity.

7. The apparatus as defined in claim 6 wherein said thermostat is secured together with fuse means by said fitting means.

8. The apparatus as defined in claim 2, wherein said control circuit means is connected with a power switch operatively interlocked with the first and second switch means.

9. The apparatus as defined in claim 1 or 2, wherein said control circuit means and heater means are connected parallel with said motor means.

10. In an apparatus for drying genitals and the posterior parts of a human body comprising a fan to blow air for drying genitals and the posterior parts said fan having a casing and heater means for heating the air, a fitting device for fitting a thermostat and fuse means upon said fan casing comprising a plate-like middle portion securedly mounted upon the outer side surface of the fan casing by screw means; a thermostat holding portion at one end of the middle portion which is curved to form a space with the casing for receiving the thermostat; a fuse means holding portion integral with one side of the middle portion in the vicinity of the opposite end of the middle portion, said fuse holding portion being curved to form a space with the fan casing to receive the fuse means; and a stopper portion which is bent normal to the middle portion extending from the fuse means holding portion, said fuse means holding portion and the stopper portion being arranged so as to abut with the outer peripheral surface of the fan casing for preventing the middle portion from rotating in a direction of the screw rotation.

* * * * *